US005489937A

United States Patent [19]

Akutsu et al.

[11] Patent Number: 5,489,937

[45] Date of Patent: Feb. 6, 1996

[54] OPTICAL CONDUCTIVE THERMAL TRANSFER INK MEDIUM

[75] Inventors: Eiichi Akutsu; Shigehito Ando, both of Ebina, Japan

[73] Assignee: Fuji Xerox Co., Ltd., Tokyo, Japan

[21] Appl. No.: 175,222

[22] Filed: Dec. 29, 1993

[30] Foreign Application Priority Data

Jan. 20, 1993 [JP] Japan ..... 5-023402

[51] Int. Cl.[6] ..... B41J 2/435

[52] U.S. Cl. ..... 347/262; 346/135.1; 347/221

[58] Field of Search ..... 347/221, 262, 347/264, 139; 346/135.1

[56] References Cited

U.S. PATENT DOCUMENTS 4,897,669 1/1990 Akutsu et al. .

5,262,800 11/1993 Smith et al. ..... 347/262

FOREIGN PATENT DOCUMENTS 4-14480 1/1992 Japan .

OTHER PUBLICATIONS

Mitsuru IRIE et al.; "High Definition Thermal Transfer Printing Using Laser Heating"; 1992; pp. 368–371.

"Tsuden netsu tensha housiki ni yoru color video printer I" (Color Video Printer Using Conductive Thermal Transfer System I); Japan, 1986; pp. 1–6.

"Tsuden nessha kiroku heddo no kaihatsu" (Development of Conductive Thermal Transfer Recording Head); Japan, 1988; pp. 25–30.

"Laser netsu tensha no kiroku tokusei V" (Characteristics of Thermal Transfer Printing by Laser Heating V—Study of Recording Energy–); Japan, 1992; pp. 45–48.

*Primary Examiner*—Mark J. Reinhart

*Attorney, Agent, or Firm*—Oliff & Berridge

[57] ABSTRACT

An optical conductive thermal transfer ink medium is disclosed, comprising at least the following layers laminated on a light-transmitting substrate in this order: a light-transmitting conductive layer, a photothermal layer exhibiting photoconductivity, a conductive layer and a thermal transfer ink layer and which is used, when printing, by applying a voltage between the light-transmitting conductive layer and the conductive layer. It may also comprise a low surface energy protection layer between the conductive layer and the thermal transfer ink layer or a conductive heating layer between the photothermal layer and the conductive layer, in the above described structure.

7 Claims, 5 Drawing Sheets

OPTICAL CONDUCTIVE THERMAL TRANSFER INK MEDIUM

FIELD OF THE INVENTION

The present invention relates to an optical conductive thermal transfer ink medium which can be used for printing on a recording medium by heat generated by conduction, which is carried out by light corresponding to image information impinging on the ink medium.

BACKGROUND OF THE INVENTION

Recently, as recording systems distinct from the thermal transfer recording system using a thermal head, a conductive thermal transfer recording system, a laser thermal transfer recording system and an optical thermal conversion recording system have been proposed.

Generally, a conductive thermal transfer system, as shown in FIG. 10, comprises a conductive thermal transfer ink medium d wherein a conductive layer b and an ink layer c are laminated on an ohmic layer a in that order and a conductive transfer recording (stylus) head g wherein a plurality of electrodes f are provided on an insulating substrate e. By making the conductive transfer recording (stylus) head g and the return electrode h contact the ohmic heating layer a and applying a voltage in accordance with the image information to specified electrodes f of the recording head g, a current is selectively supplied between the electrodes f and the conductive layer b, by which the ohmic heating layer a disposed between them is heated and ink from the portions corresponding to the heated portions x of the ink layer is transferred to a recording medium i. This mechanism is described in documents such as "Tsuden netsu tensha houshiki ni yoru color video printer I" (Color Video Printer Using Conductive Thermal Transfer System I), Minoru Usui, Manabu Nishiwaki et al., a document prepared for Gazou Denshi Gakkai 93th research symposium, 1986, pp. 1–6, "Tsuden nessha kiroku heddo no kaihatsu" (Development of Conductive Thermal Transfer Recording Head), Hiroyuki Sawai, You Ishii et al., a document prepared for Gazou Denshi Gakkai 102th research symposium, 1988, pp. 25–30.

Compared to a thermal transfer recording system using a thermal head, this conductive thermal transfer system is capable of printing at high speed and with high quality on plain paper.

This system, however, has technical problems with high density printing of the order of 31.49606 dots/mm (800 dpi), which makes it difficult to make a recording head g in respect of its mechanical structure and increases the manufacturing cost significantly. Further, in this system, as conduction and heating are carried out by contacting the recording head g with the conductive thermal transfer ink medium i, the following problems tend to occur: a tendency to image degradation because of non-uniformity of the printed dot diameter in the axial direction of the print head, reduction of print quality caused by abrasion of electrodes and attachment of printing debris between electrodes, and the difficulty of increasing the printing speed in respect of heating efficiency.

The laser thermal transfer recording system, as shown in FIG. 11, comprises a laser thermal transfer ink medium m formed of a substrate i having an optical thermal conversion heating layer k of carbon black or the like and an ink layer l laminated thereon. If a laser light n corresponding to an image information is directed at the substrate i, the portion x of the heating layer k corresponding to the laser light is selectively heated, and the ink from the corresponding portion of the ink layer l is transferred to a recording medium i, and thus printing is carried out. This system is described in, for example, "Laser netsu tensha no kiroku tokusei V" (Characteristics of Thermal Transfer Printing by Laser Heating-Study of Recording Energy-), Mitsuru Irie and Takashi Kitamura, a thesis prepared for the Denshi Shasin Gakkai annual symposium "Japan Hard Copy '92", 1992, pp. 45–48.

Although the problems of the above described conductive thermal transfer system, particularly the problems with high density recording, are solved with this laser thermal transfer recording system, as it has a mechanism wherein the optical thermal conversion heating layer k on which the laser light n impinges generates heat itself and the heat is conveyed by thermal diffusion to the ink layer l, the recording sensitivity may be reduced by the expansion of the heating region, there may be loss and absorption of heat in the heating layer caused by the thermal diffusion, and increasing the printing speed is also difficult. This system is suitable for monochrome printing, but in color printing, recording sensitivity and recording speed have tendency to be reduced as described above.

The optical thermal conversion recording system, as shown in FIG. 12, comprises a heating rotatable drum s formed of the following layers laminated on a light-transmitting hollow cylinder o in this order: a transparent conductive layer p, a photoconductive layer q and a conductive layer r and between the transparent conductive layer p and the conductive layer r of which, a voltage is applied. The laser light n in accordance with image information is directed from inside the cylinder of the heating rotatable drum s, and selectively makes the photo-conductive layer q conductive, allowing a current to flow, and thus heating the portion x corresponding to the laser light. In this way, as in a thermal head, ink from the heat-sensitive transfer film t is transferred to a recording medium i which is transported between the heating rotatable drum s and the roller v with the heat-sensitive transfer film t therebetween. This system is described in, for example, Japanese unexamined patent publication No. Hei 4-14480 (1992). In the figure, x is the heating portion, u is a power source and v is a platen roller.

Compared to the conventional recording system using a thermal head or a conductive transfer recording head, as this optical thermal conversion recording system uses a heating rotatable drum s wherein the heat for image printing is generated by light radiation as a thermal head, there is less friction between the recording head and the heat-sensitive recording material, that is the ink medium t. Therefore, distortion when printing and reduction of printing quality caused by attachment of debris is prevented.

With this recording system, however, the thermal retention phenomenon of the recording head in accordance with the increase of printing speed is reduced, because the same portions are not heated repeatedly as in a conventional thermal head, but the following problems tend to occur: non-uniformity of print density which is caused by the thermal retention phenomenon in the heating rotatable drum (head) s caused by high speed or long-term printing, and the reason for which is also the lack of stability over time of the heating characteristics, non-uniformity of the printed dot diameter in the axial direction of the print head because heating and then printing is carried out by making the heating rotatable drum s, which is a recording head, contact the heat-sensitive recording material t as in a conventional thermal head, non-uniformity of print density caused by the loss or failure when conveying heat from the rotatable drum s to the heat-sensitive recording material t or debris on the drum surface, the difficulty of increasing the printing speed in respect of thermal conveying efficiency, and so forth.

SUMMARY OF THE INVENTION

It is an object of the present invention to provide a conductive thermal transfer ink medium free of the defects found in the conventional art.

It is another object of the present invention to provide a conductive thermal transfer ink medium which is capable of high density printing.

It is a further object of the present invention to provide a conductive thermal transfer ink medium which is capable of printing at high speed and with high quality, free of non-uniformity of printed dot diameter and density.

Additional objects and advantages of the invention will be set forth in part in the description which follows and in part will be apparent from the description, or may be learned by practice of the invention.

The present invention relates to an optical conductive thermal transfer ink medium comprising at least the following layers laminated on a light-transmitting substrate in this order: a first light-transmitting conductive layer, a photothermal layer exhibiting photo-conductivity, a second conductive layer and a thermal transfer ink layer and which is used, when printing, by applying a voltage between the first light-transmitting conductive layer and the second conductive layer.

The present invention also relates to an optical conductive thermal transfer ink medium which may comprise in the above described structure a low surface energy protection layer between the conducive layer and the thermal transfer ink layer or a conductive heating layer between the photothermal layer and the conductive layer.

BRIEF DESCRIPTION OF THE DRAWING

The manner by which the above objects and other objects, features and advantages of the present invention are attained will be fully evident from the following detailed description when it is considered in light of the accompanying drawings, wherein.

DETAILED DESCRIPTION OF THE INVENTION

Figure 1:
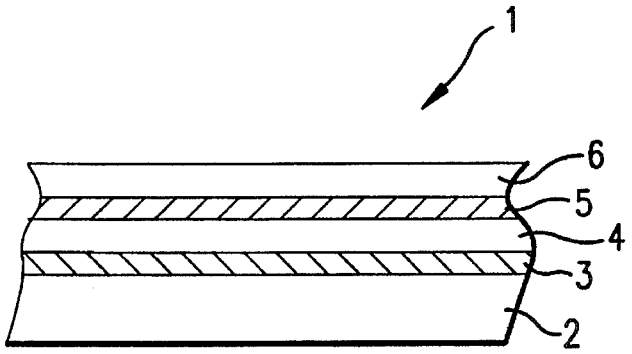
FIG. 1 is a cross-sectional view showing a first embodiment of the optical conductive thermal transfer ink medium according to the present invention.

For a light-transmitting substrate, may be used any material which transmits light emitted for printing and has excellent heat resistance preferably at least to 423.15 K. (150° C.), for example, transparent heat resistant plastic film, glass mainly comprising silicon oxide, or inorganic materials such as bromine fluoride. If the heat resistant temperature of this substrate is less than 423.15 K. (150° C.), the substrate may be deformed, by the thermal damage caused by heat generated for printing, which may impair the printing quality. As the plastic film, resins such as polyimide, aromatic polyamide, polyester or polyimide amide and resin materials including derivatives thereof may be used. The thickness of the layer is preferably in the range from 20 μm to 5 mm.

The material used for the light-transmitting conductive layer should transmit at least 30 percent of the light used for printing and be conductive having a volume resistivity of not more than $10^5$ Ω.m. For the light-transmitting conductive layer may be used metal materials such as indium oxide, tin oxide, chromium oxide, crystallized polyacetylene in single layer form, including one material in single layer form, or in their mixture layer or their compound layer form, and the thickness is preferably not more than 5 μm in view of light transmission characteristics.

The photoconductive photothermal layer is made of a material which exhibits at least three times as much conductivity as the ordinary state when light impinges on it; that is, the volume resistivity of the illuminated surface is less than one-third of that of non-illuminated surface, and is heat resistant up to at least 393.15 K. (120° C.). If the photoconductivity thereof does not satisfy the above described condition, sufficient heating may not be obtained, and if the photothermal layer is not heat resistant at least to 393.15 K. (120° C.), problems such as reduction of the quality of the layer when heating are caused. The photothermal layer is made of, for example, selenium, silicon, sulfur, cadmium sulfide, zinc oxide, or alloys thereof made of, for example, a metal such as selenium, silicone, sulfur, cadmium sulfide, zinc oxide, or alloys thereof or a phthalocyanine dye, perylene dye or the like, and the thickness should be 0.01 to 50 μm, preferably 0.1 to 5 μm.

The conductive layer provided on the photothermal layer is a thin layer of a conductive material having a volume resistivity of not more than $10^2$ Ω.cm. For the conductive material, may be used C and a metal such as Ni, Au, Ag, Fe, Ai, Ti, Pd, Ta, Cu, Co, Cr, Pt, Mo, Ru, W, In and metal compounds such as $VO_2$, $Ru_2O$, TaN, SiC, $ZrO_2$, InO, $Ta_2O$, ZrN, NbN, VN, $TiB_2$, $HfB_2$, $TaB_2$, $MoB_2$, $CrB_2$, $B_2C$, MoB, ZrC, VC and TiC. The thickness of this layer is preferably not more than 5 μm.

The thermal transfer ink layer is made of an ink material which is transferred to a recording medium by fusion or sublimation caused by heating. It is formed of, for example, a solid or powder ink composition having colorants and, if necessary, additives dispersed in a thermoplastic resin, or an ink composition mainly comprising subliming dye. If powder ink material is used for the ink composition, the layer may be a so-called regenerative ink layer to which ink material corresponding to the amount of ink consumed for printing is supplied.

The low surface energy protection layer is formed of a material having a critical surface tension of not more than 30 dyne/cm, preferably not more than 20 dyne/cm and a heat resistance at least to 423.15 K. (150° C.). If the critical surface tension exceeds 30 dyne/cm, problems such as insufficient transfer of ink material to the recording medium may occur. For the material of the protection layer, may be used a silicone resin, a fluorine-containing polymer or a modified resin thereof, and the thickness of the layer is not more than 5 μm, preferably not more than 1 μm. In addition to the above described characteristics, the layer may have a glass transition point of not more than the room temperature and a weak viscosity which barely allows the ink composition to be attached. With such characteristics, the ink layer can be regenerated after being used, which makes the ink medium regenerative.

The conductive heating layer functions as a supplementary heating layer of the photothermal layer and has a heat resistance of at least 423.15 K. (150° C.). It also exhibits conductivity, having a volume resistivity of $10^{-2}$ to $10^{6}$ Ω.m. For the material of the conductive heating layer may be used one ceramic material in single layer form, various ceramic materials in single layer form, or in their mixture layer or their compound layer form, or heat-resistant resin and conductive material or insulating filler of a single type or of a plurality of types in mixture layer or compound layer form, or various ceramic materials and metal materials in mixture layer or compound layer form.

For the above described heat-resistant resin, may be used polyimide resin, aromatic polyamide resin, polyester resin, polyimide amide resin, polysulfone resin, polyphenylene oxide resin, poly-p-xylene resin or the like, or resin materials comprising derivatives thereof. For the above described conductive material (filler), may be used metals and metal compounds used for the conductive layer. The conductive material may comprise insulating materials for reducing the resistance value and binding, and for the insulating material may be used the above described heat-resistant resins and various ceramic materials such as alumina, zirconia, silicon compounds and magnesium compounds.

Figure 2:
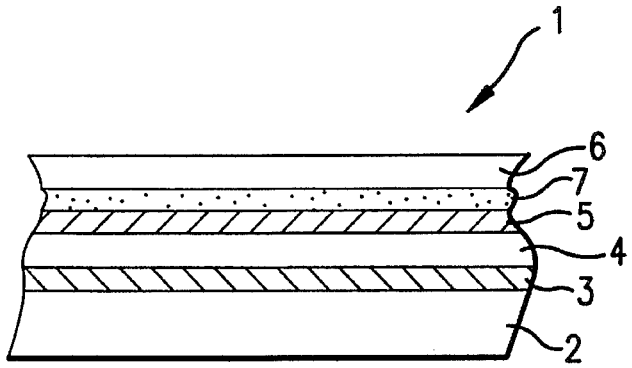
FIG. 2 is a cross-sectional view showing a second embodiment of the conductive thermal transfer ink medium according to the present invention.
Figure 3:
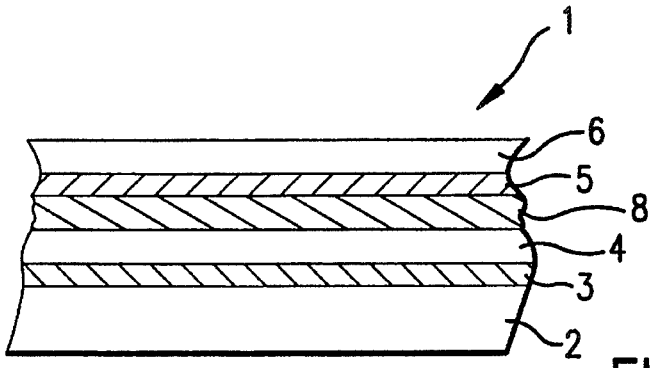
FIG. 3 is a cross-sectional view showing a modified example of the embodiment shown in FIG. 1 of the conductive thermal transfer ink medium according to the present invention.
Figure 4:
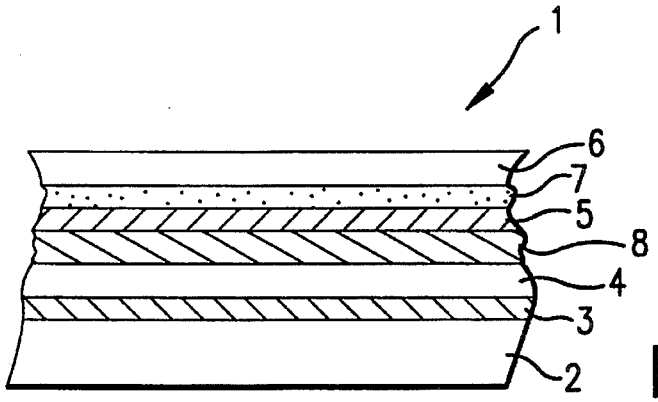
FIG. 4 is a cross-sectional view showing a third embodiment of the conductive thermal transfer ink medium according to the present invention.

The optical conductive thermal transfer ink medium 1 of the present invention, as shown in FIG. 1, basically comprises the following layers laminated on a light-transmitting substrate in this order: a light-transmitting conductive layer 3, photothermal layer 4, conductive layer 5 and thermal transfer ink layer 6. In addition to these, the ink medium having this basic structure may comprise a low surface energy protection layer 7 between the conductive layer 5 and the ink layer 6 as shown in FIG. 2, and it may also comprise a conductive heating layer 8 between the photothermal layer 4 and the conductive layer 5 as shown in FIG. 3. Further, it may comprise a low surface energy protection layer 7 and a conductive heating layer 8 both provided between the conductive layer 5 and the ink layer 6 as shown in FIG. 4.

When making an ink medium of such a laminate, the light-transmitting conductive layer, photothermal layer, conductive layer and conductive heating layer are formed by any appropriately selected known film forming process, and the low surface energy protection layer and ink layer are formed by any appropriately selected coating process.

Figure 5:
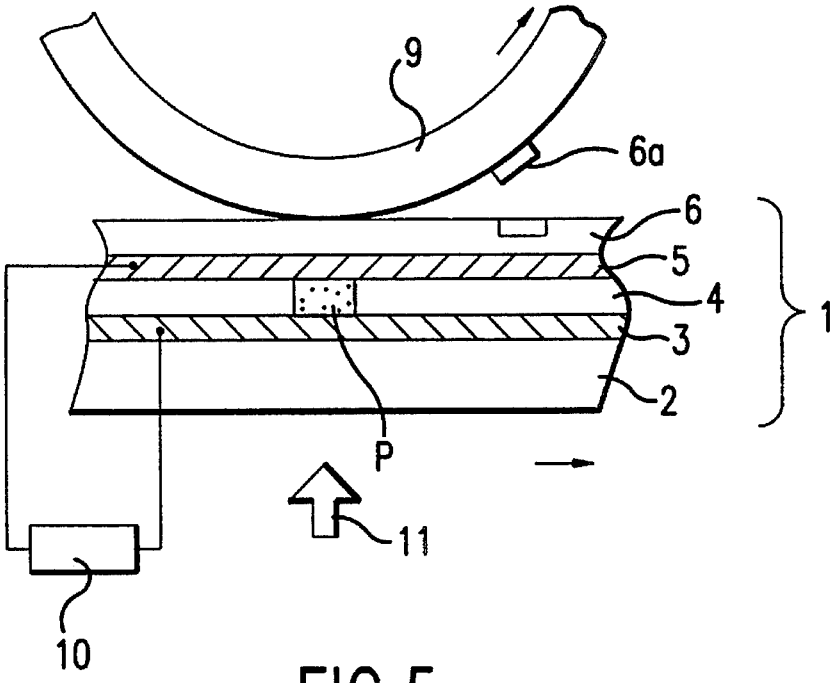
FIG. 5 illustrates the printing system of the conductive thermal transfer ink medium according to the present invention.

When printing using the optical conductive thermal transfer ink medium 1 of the present invention, as shown in FIG. 5, the surface of the ink layer 6 of the ink medium 1 is made to contact the recording material 9 under pressure and a specified voltage is applied between the light-transmitting conductive layer 2 and the conductive layer 5 from the power supply 10. In this state, light corresponding to the image signal is emitted.

The voltage applied then is appropriately specified based on the photo-conductivity of the photothermal layer, that is the degree of variation of the resistance value in the illuminated and non-illuminated portions, the effective resistance value of the conductive heating layer and the light emission conditions such as light strength. To apply a voltage, one or both end portions of each of the light-transmitting conductive layer and conductive layer is exposed at one or both end portions of the ink medium, such that the light-transmitting conductive layer and conductive layer contact electrodes for applying the voltage.

As a light source, may be employed a light scanning device using laser light, light writing device using an LED array or the like, a light writing device using a liquid crystal shutter array, or two-dimension exposure or slit exposure devices using an analog light image. To improve the conventional half-tone reproduction of high contrast in highlights, a pseudo dot screen method using laser light and line screen or a dot screen method with respect to analogue light image may be applied.

Figure 6:
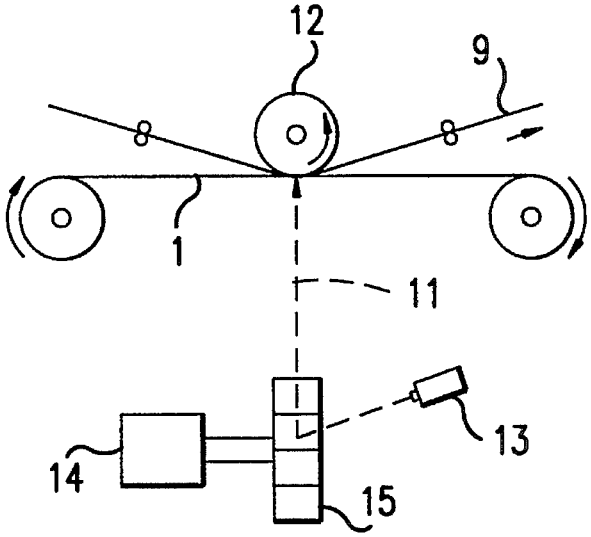
FIG. 6. is a conceptual view of an example of the printing mechanism comprising the conductive thermal transfer ink medium according to the present invention.
Figure 7:
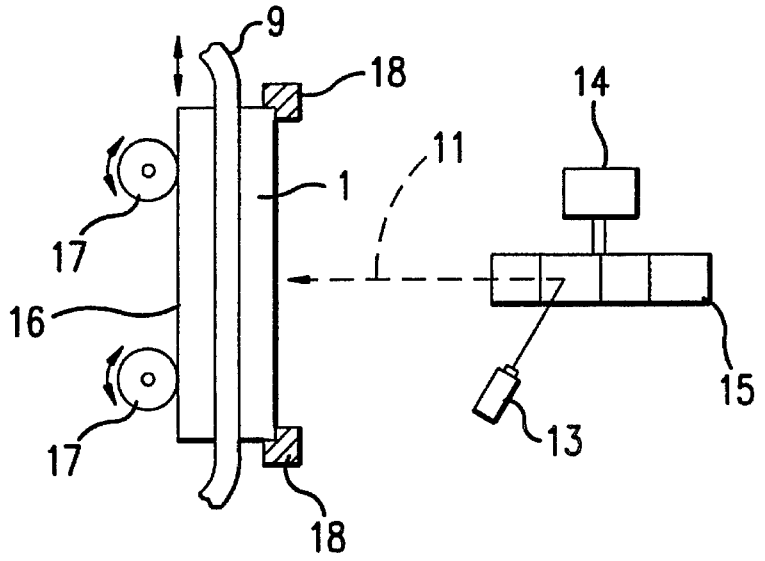
FIG. 7 is a conceptual view of another example of the printing apparatus comprising the conductive thermal transfer ink medium according to the present invention.
Figure 8:
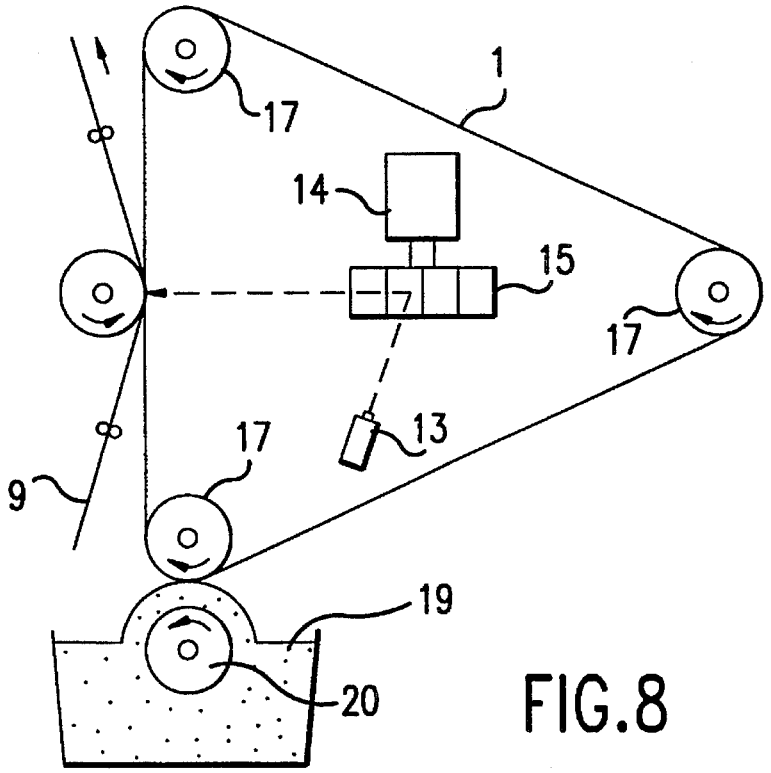
FIG. 8 is a conceptual view of yet another example of the printing mechanism comprising the conductive thermal transfer ink medium according to the present invention.

FIG. 6 shows an example of an actual printing device. In it, the recording material 9 is made to contact the ink layer of the conductive thermal ink medium 1 whose end portions are wound around rollers, by platen roller 12 under pressure, and the laser light 11 generated from the laser element 13 is directed at the ink medium 1 through the polygonal mirror 15 which is rotated by the motor 14. FIG. 7 shows another example of an actual printing device. In it, the recording material 9 is made to contact the ink layer of the conductive thermal ink medium 1 by means of the platen board 16, and light emission is carried out in the same way as described above. Here, the substrate of the conductive thermal ink medium 1 used for flash two-dimension exposure or the like is made of glass. In the figure, 17 are transport rollers to move the platen board 16, and 18 are fixing units for the recording medium.

When using a regenerative ink medium 1, the recording material 9 is made to contact the ink medium 1 which is supported by a plurality of transport rollers 17 such that it is in the form of an endless belt, and light emission is carried out in the same way as described above. In it, an ink attaching roller 20 which attaches, after printing, ink material 19 to the ink layer of the ink medium 1 is provided.

With these mechanical structures, if light emission 11 is carried out as shown in FIG. 5, the light reaches the specified portions of the photothermal layer 4 and the resistance value in the illuminated portions P is greatly reduced, making the material conductive. Thus, the current caused by the applied voltage flows between the light-transmitting conductive layer 3 and the conductive layer 5 through the illuminated portions P, by which the illuminated portions of the photothermal layer 4 are heated. The thermal image is conveyed to the ink layer 6, by which the ink material is thermally fused or sublimated, and the fused or sublimated ink material 6*a* is transferred to the recording material 9, thus carrying out printing.

If a low surface energy protection layer 7 is provided, it allows the ink material thermally fused or sublimated on the protection layer to be transferred positively and effectively by the repellence quality thereof, and it also prevents the returning property of the ink material, with which the ink has a tendency to go back to the ink medium immediately after being transferred.

Further, if a conductive heating layer 8 is provided, the portion corresponding to the illuminated portion P is heated by the supplied current at the same time as the photothermal layer 4 is heated, and more heat is generated, which causes the ink material to be fused or sublimated more positively and effectively.

EMBODIMENTS

The present invention is now described in more detail, referring to embodiments.

EMBODIMENT 1

A conductive thermal transfer ink medium comprising the layers as shown in FIG. 1 was prepared with the following manner.

A transparent conductive layer 3 having a surface resistivity of 25 Ω was formed by depositing on the surface of a polyimide film substrate 2 having a thickness of 50 μm using a target made of a mixture of indium oxide and tin oxide to a thickness of 300 nm by the high frequency sputtering method, with the substrate temperature maintained at 573.15 K. (300° C.). A photothermal layer 4 of amorphous silicon having a thickness of 7 μm was formed by plasma CVD deposition process, wherein glow discharge was performed, with the substrate temperature maintained at 523.15 K. (250° C.) and with silicon hydride being supplied into the vacuum chamber containing the entire device. A conductive layer 5 was formed by depositing aluminum on the photothermal layer 4 to a thickness of 300 nm by sputtering process, with the substrate temperature maintained at 473.15 K. (200° C.), and after that, an ink layer 6 having a thickness of 4.5 μm was formed by applying on the conductive layer 5 by blade coating process an ink solution wherein an ink material comprising a polyester resin having a melting point of 371.15 K. (98° C.) and phthalocyanine pigment whose proportion with respect to the polyester resin was 13 weight percent was dissolved with a solvent, and thus a conductive thermal transfer ink medium 1 was completed.

The obtained conductive thermal transfer ink medium 1 was applied to a laser light scanning printing device as shown in FIG. 6 and printing test was done, with the following conditions. The printing device used a laser diode having a wavelength of 780 nm and an output of 20 mW as a laser element 13 and a polygonal mirror 15 which controlled the input image information in accordance with image signals. As the recording material 9, a copy sheet was used, and the sheet was made to contact the surface of the ink layer of the conductive thermal transfer ink medium 1 by the platen roller 12 under a pressure of 200 g/mm$^2$ and a DC voltage of 140 V was applied between the light-transmitting conductive layer 3 and the conductive layer 5. When printing was carried out at a high speed of 190 mm/s under the above described conditions, a cyan image having an optical image density of 1.3 was formed on the copy sheet. The image had a little dot diameter non-uniformity, some dot failure and white streaks, but there was almost no damage in practical use, which sufficiently allowed the image to be regarded as a good image. The interfacial surface tension of the aluminum conductive layer of the ink medium according to the present embodiment was 68 dyne/cm.

Figure 9:
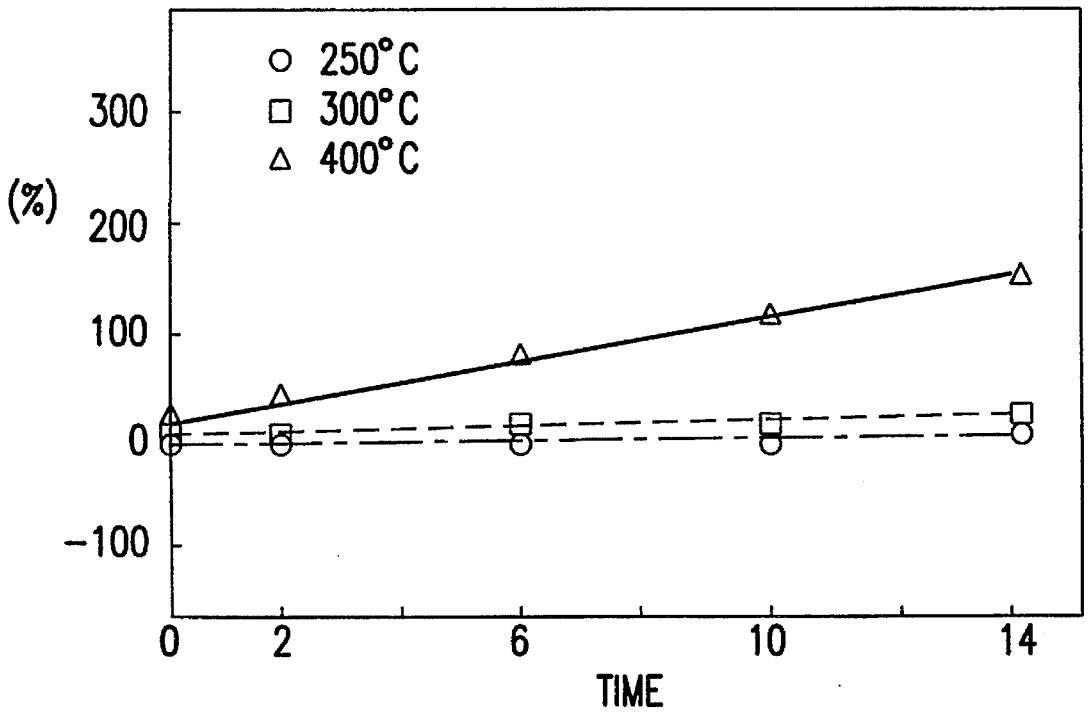
FIG. 9 shows the variation over time of the surface resistivity of the photothermal layer under three temperature environments while the ink medium is disposed in a constant temperature chamber.
Figure 10:
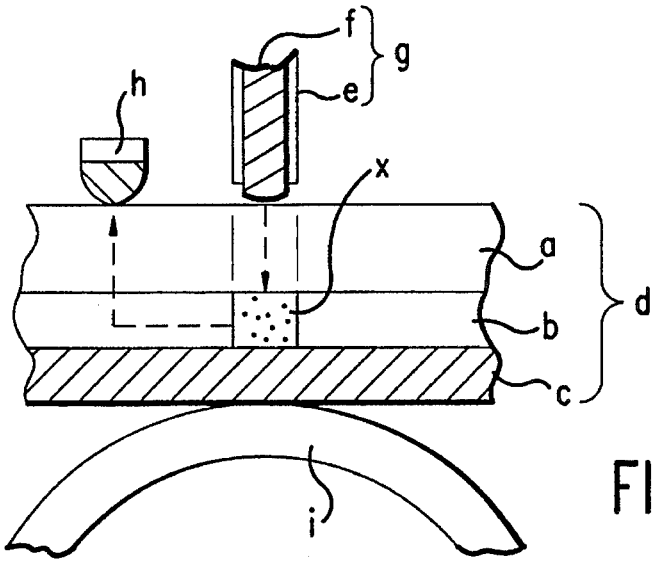
FIG. 10 illustrates the conventional conductive thermal transfer recording system.
Figure 11:
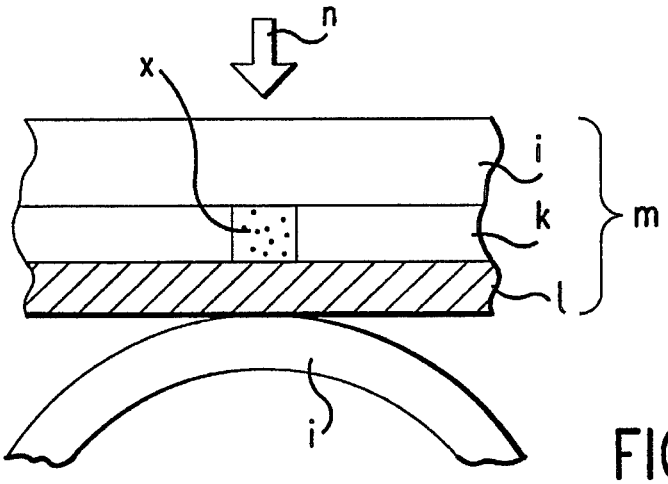
FIG. 11 illustrates the conventional laser thermal transfer recording system.
Figure 12:
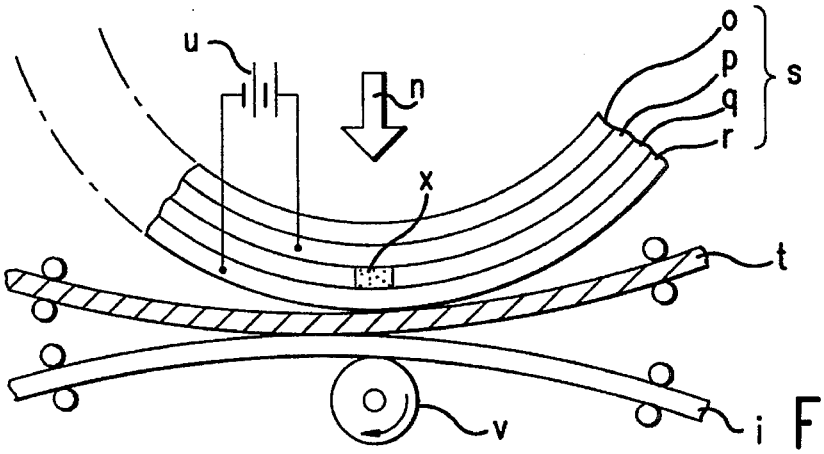
FIG. 12 illustrates the conventional optical thermal conversion recording system.

FIG. 9 shows the relation between the degree of variation of the surface resistivity and the time for which the photothermal layer 4 of amorphous silicon film of the conductive thermal transfer ink medium 1 was provided in constant temperature chambers, each temperature of which were specified to be 523.15 K. (250° C.), 573.15 K. (300° C.) and 673.15 K. (400° C.).

As a result of FIG. 9, the surface resistivity of the photothermal layer 4 of amorphous silicon film was very stable over time if the temperature range of the illuminated portion P of the ink medium was within 573.15 K. (300° C.). Therefore, the surface resistivity of the photothermal layer 4 was also stable, with the temperature of P being approximately in the range from 333.15 K. (60° C.) to 393.15 K. (120° C.), with which the transfer of ink material was caused.

Accordingly, if printing is carried out using an ink medium as prepared according to the present invention, the surface resistivity of the photothermal layer is almost stable, being independent of the heating temperature when printing, so photo-conductivity and heating quality are always stable and positive in the photothermal layer with respect to the light radiation, and it is considered theses qualities may contribute to good printing.

EMBODIMENT 2

A conductive thermal transfer ink medium 1 was prepared in the same manner as embodiment 1 except that a low surface energy protection layer 7 having a thickness of 1.2 μm and an interfacial surface tension of 17 dyne/cm was formed on the conductive layer 5 before forming the ink layer 6 as shown in FIG. 2, by applying a solution of fluorine-containing silicone resin on the conductive layer, drying and hardening them at 473.15 K. (200° C.) for 30 minutes. When printing test was carried out using the conductive thermal transfer ink medium 1 under the same conditions as embodiment 1, a cyan image having an optical image density of 1.3 was formed on the copy sheet, and the image was good, having a printing dot diameter of 30 μm (about 800 spi), a dot diameter non-uniformity (σ) of 3.1 μm and free of dot failure or white streaks, which were shown in embodiment 1.

EMBODIMENT 3

A transparent conductive layer 3 having a thickness of 0.5 μm was formed on one side of a vitreous glass substrate 2 having a thickness of 3 mm as shown in FIG. 4 by depositing an indium tin oxide film by sputtering process, and a photothermal layer 4 of amorphous silicon having a thickness of 3 μm was formed on the conductive layer 3 by plasma CVD deposition process wherein glow discharge was performed with the substrate temperature maintained at 543.15 K. (270° C.) and with silicon hydride being supplied into the vacuum chamber containing the entire device. Then, a conductive heating layer 8 having a thickness of 3 μm was formed by applying a coating of polyimide resin solution wherein 17 weight percent of carbon black particles were dispersed, drying and hardening them. A conductive layer 5 was formed by depositing an alloy of nickel and aluminum on the conductive heating layer 8 to a thickness of 0.4 μm by high frequency sputtering process, and a low surface energy protection layer 7 having a thickness of 1.2 μm, a viscosity on its surface and an interfacial surface tension of 19 dyne/cm was formed on the conductive layer 5 by applying a dip coating of silicone rubber film, drying and thermally hardening them. A powder ink layer 6 was formed on the surface by dropping toner like a waterfall with respect to the surface of the photoreceptor by cascade developing method a powder ink material which has an average particle diameter of 15 μm and comprises a resin mainly comprising a polyethylene wax whose melting point was 338.15 K. (65° C.) and 12 weight percent of carbon black, and thus a conductive thermal transfer ink medium 1 was prepared.

The conductive thermal transfer ink medium 1 was applied to the laser light scanning printing device as shown in FIG. 7, and printing test was carried out under the following conditions. For a printing device, the same laser element 13 and a polygonal mirror 15 as embodiment 1 were used and scanning control was performed in accordance with image signals. For a recording material 9, a copy sheet was used, and the sheet was made to contact the surface of the ink layer of the conductive thermal transfer ink medium 1 under pressure of 400 g/mm$^2$ by a platen board 16, and a DC voltage of 60 V was applied between the light-transmitting conductive layer 3 and the conductive layer 5.

When printing was carried out under such conditions, a cyan image having an optical image density of 1.4 was formed on the copy sheet and it was a good image, free of dot diameter non-uniformity, dot failure or white streaks.

What is claimed is:

1. An optical conductive thermal transfer ink medium comprising at least the following layers laminated on a light-transmitting substrate in this order: a light-transmitting conductive layer, a photothermal layer exhibiting photoconductivity, a conductive layer, a low surface energy protection layer, and a thermal transfer ink layer, and wherein ink is transferred from the ink medium when a power supply applies a specified voltage between the light-transmitting conductive layer and the conductive layer.

2. The optical conductive thermal transfer ink medium described in claim 1, wherein a conductive heating layer is provided between the photothermal layer and the conductive layer.

3. An optical conductive thermal transfer ink medium comprising at least the following layers laminated on a light-transmitting substrate in this order: a light-transmitting conductive layer, a photothermal layer exhibiting photoconductivity, a conductive heating layer, a conductive layer and a thermal transfer ink layer, and wherein ink is transferred from the ink medium when a power supply applies a specified voltage between the light-transmitting conductive layer and the conductive layer.

4. The optical conductive thermal transfer ink medium according to claim 2, wherein said light-transmitting conductive layer, said photothermal layer exhibiting photoconductivity, said conductive layer and said conductive heating layer are formed by a film forming process, and wherein said low surface energy protection layer and said thermal transfer ink layer are formed by a coating process.

5. The optical conductive thermal transfer ink medium according to claim 3, wherein a surface resistivity of said photothermal layer is independent of a heating temperature during transfer of the ink from said ink medium.

6. An optical thermal conductive recording system comprising:

a recording device;

an image forming device contacting said recording device, wherein said image/forming device includes an optical conductive thermal transfer ink medium comprising at least the following layers in sequence:
a light-transmitting conductive layer,
a photothermal layer exhibiting photo-conductivity,
a conductive layer,
a low surface energy protection layer, and
a thermal transfer ink layer;

illuminating means for selectively heating said image forming means;

a power supply, wherein said layers are constructed and arranged so that when said power supply applies a voltage potential between the light-transmitting conductive layer and the conductive layer, and the optical conductive thermal transfer ink medium is illuminated through the light transmitting conductive layer, corresponding areas of the photothermal layer become conductive enhancing current flow and causing localized heating in the photothermal layer sufficient to thermally activate corresponding areas of the thermal transfer ink layer and activating a repelling quality of the low surface energy protection layer.

7. The optical thermal conversion recording system according to claim 6, further comprising a conductive heating layer between the photothermal layer and the conductive layer, wherein the conductive heating layer is heated by said voltage potential at the same time as the photothermal layer.

* * * * *